US005911270A

United States Patent [19]

Westerlund

[11] Patent Number: 5,911,270

[45] Date of Patent: Jun. 15, 1999

[54] ROTARY REGENERATIVE HEAT EXCHANGER

[75] Inventor: Dag Westerlund, Järfälla, Sweden

[73] Assignee: Svenska Rotor Maskiner AB, Stockholm, Sweden

[21] Appl. No.: 08/981,484

[22] PCT Filed: Aug. 7, 1996

[86] PCT No.: PCT/SE96/00993

§ 371 Date: Dec. 22, 1997

§ 102(e) Date: Dec. 22, 1997

[87] PCT Pub. No.: WO97/07374

PCT Pub. Date: Feb. 27, 1997

[30] Foreign Application Priority Data

Aug. 17, 1995 [SE] Sweden ..... 9502874

[51] Int. Cl.[6] ..... F23L 15/02

[52] U.S. Cl. ..... 165/9; 165/8; 165/10

[58] Field of Search ..... 165/10, 9, 8, 6, 165/4

[56] References Cited

U.S. PATENT DOCUMENTS

| | | | |
|---|---|---|---|
| 3,010,704 | 11/1961 | Egbert | 165/9 |
| 4,256,171 | 3/1981 | Zeek | 165/9 X |
| 4,705,098 | 11/1987 | Gerber et al. | 165/9 X |

FOREIGN PATENT DOCUMENTS

| | | | |
|---|---|---|---|
| 983474 | 2/1976 | Canada | 165/9 |
| 60-0020087 | 2/1985 | Japan | 165/9 |
| 503 801 | 9/1996 | Sweden . | |
| 2 065 855 | 7/1981 | United Kingdom . | |
| WO 95/00809 | 1/1995 | WIPO | 165/6 |
| WO 95/01541 | 1/1995 | WIPO | 165/9 |

*Primary Examiner*—Ira S. Lazarus
*Assistant Examiner*—Christopher Atkinson
*Attorney, Agent, or Firm*—Frishauf, Holtz, Goodman, Langer & Chick

[57] ABSTRACT

A regenerative heat exchanger having a first part which is essentially cylindrical and which contains a regenerator mass, and a second part which comprises axially directed inlet ducts and outlet ducts for heat emitting and heat absorbing media. The inlet and outlet ducts are separated from each other by sector shaped plates positioned for sealing purposes close to end surfaces of the first part, and the sector shaped plates are pivotally connected to axially fixed center plates positioned at ends of the first part and attached to the second part. At least one cylindrical stop bar is provided at a radial outer end of each of the sector shaped plates for setting a clearance between the radial outer ends of the sector shaped plates and respective edge flanges provided at each end of the first part. The stop bars are mounted perpendicular to the sector shaped plates and are journalled in an axially displaceable manner in respective cylindrical sockets provided at the radial outer ends of the sector shaped plates. The stop bars are adjustable by a screw mechanism connected to the respective ends of the sector shaped plates. In addition, at least one axial through passage, formed between a peripheral surface of each of the stop bars and an inside surface of the respective cylindrical sockets, is provided through which a first pressurized fluid may be applied. One of the first part and the second part is rotatable relative to the other around a common center axis.

23 Claims, 3 Drawing Sheets

ROTARY REGENERATIVE HEAT EXCHANGER

The present invention relates to a regenerative heat exchanger.

BACKGROUND OF THE INVENTION

Regenerative heat exchangers are SE 9302148-3 which discloses bars in the form of sliding shoes made of carbon or graphite. This is a material that does not get damaged rapidly by the corrosive environment that is present at the locations where the sliding shoes are situated, and that withstands the prevailing high temperatures. Moreover, the material also has excellent lubrication properties and deposits a friction reducing layer of carbon or graphite on the flanges against which the sliding shoes are sliding. This, however, at the same time involves abrasion of the sliding shoes with a rate that has proved difficult to foresee. For that reason it has been necessary to complement each sliding shoes with measuring devices, which measure the clearance between the sector plates and the flanges, and which make it possible to screw forward the stop bars or sliding shoes a certain distance from their mounting means in time before the sector plates start scraping against the flanges such that the intended clearance is restored.

It is a time consuming supervision and adjusting work that is required, and therefore it is important to reduce this work as much as possible. Such a measure is to reduce the contact pressure to reduce the abrasion. A contact force amounting to about 500 N at the sliding shoes is required, however, in order to have the sliding shoes and accordingly the sector plates to follow the flanges at the thermal deformation of the cylindrical part, which sometimes has proved to result in a comparatively rapid abrasion.

SUMMARY OF THE INVENTION

The object of the invention is to attain a solution of the problem with the rapid abrasion of the stop bars or sliding shoes.

This has according to the invention been achieved by the heat exchanger having the features specified in the apprehended claims.

A jet of for instance air and/or water steam is arranged to hit the edge flange just where it is moving in under the support means, so that particles adhering more or less strongly to the edge flange and which can cause abrasion to the support means are blown away, possibly in the same moment as the particles are sheared loose by the edge of the support means and accordingly are prevented from moving in under the support means. Also a further diametrically positioned medium jet is effective in case strongly adhering particles are crumbled to small particles under the support means and appear behind the support means where they are blown away and prevented from getting stuck to the edge of the support means.

Also further passages positioned around the periphery of the support means have the same or similar purposes and are easily arranged in the shape of axial shallow grooves in the periphery surface of the support means and/or in the inner surface of the socket, in which case the passages are formed when the support means is placed in position in the socket.

The passages also have a cooling function, and one or more passages may be arranged within the periphery of the support means for achieving an effective cooling of the surface of the support means that is in contact with the edge flange.

A further function consists in that the medium jets cause a reaction force that partially can relieve pressure of the support means against the edge flanges when the support means are positioned close to the edge flanges.

Also a reinforced air cushion effect may be obtained with at least one channel positioned within the periphery surface, and a curtain as tight as possible of axial media jets around the periphery surface forming a so called skirt around the air cushion. A passage may extend without interruptions around the entire the periphery of the support means, and is preferably connected to a fluid pressure source having a higher pressure than a fluid pressure source connected to the passage or passages positioned within the periphery surface.

BRIEF DESCRIPTION OF THE DRAWINGS

The invention will be further explained in the following description with reference to the attached drawings, which schematically show different embodiments of heat exchangers according to the invention and of which

DETAILED DESCRIPTION

Figure 1:
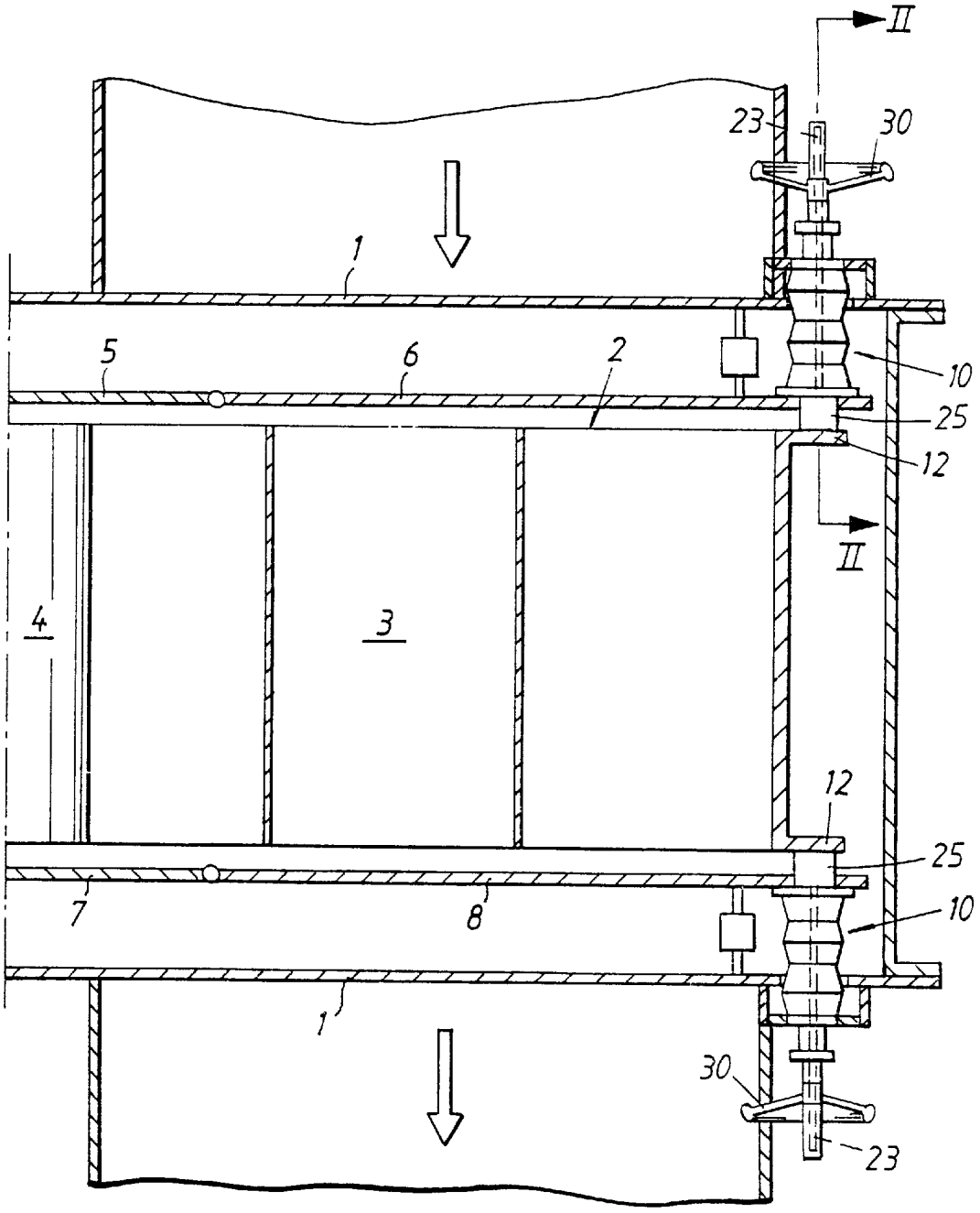
FIG. 1 is a partial axial section through the heat exchanger

The heat exchanger here shown in FIG. 1 is of conventional type having a stationary casing 1 and a cylindrical rotor 2 containing the regenerative mass 3. The rotor has a hub 4 and an upper fixed sector plate 5 with a movable sector plate 6 pivotally connected thereto and a corresponding lower fixed sector plate 7 and movable sector plate 8. The two sets of sector plates 5,6 and 7,8 have the function to seal against the upper and lower ends of the rotor 2 as tight as possible and thereby separate the heat exchanging media flowing through the rotor.

For that purpose the radially outer ends of each of the movable sector plates 6,8 are provided with one or preferably two devices 10 including an adjustable stop bar for maintaining a certain clearance between the ends of the sector plates 6,8 and an upper and lower annular edge flange 12 attached to the rotor 2 along its upper and lower peripheries. Each device further includes a measuring device, not shown, for control measurement of the clearance, as shown more in detail in said SE 9302148-3. As an alternative the sector plates 6,8 may be rotary and the regenerative mass stationary in a way known per se.

Figure 2A:
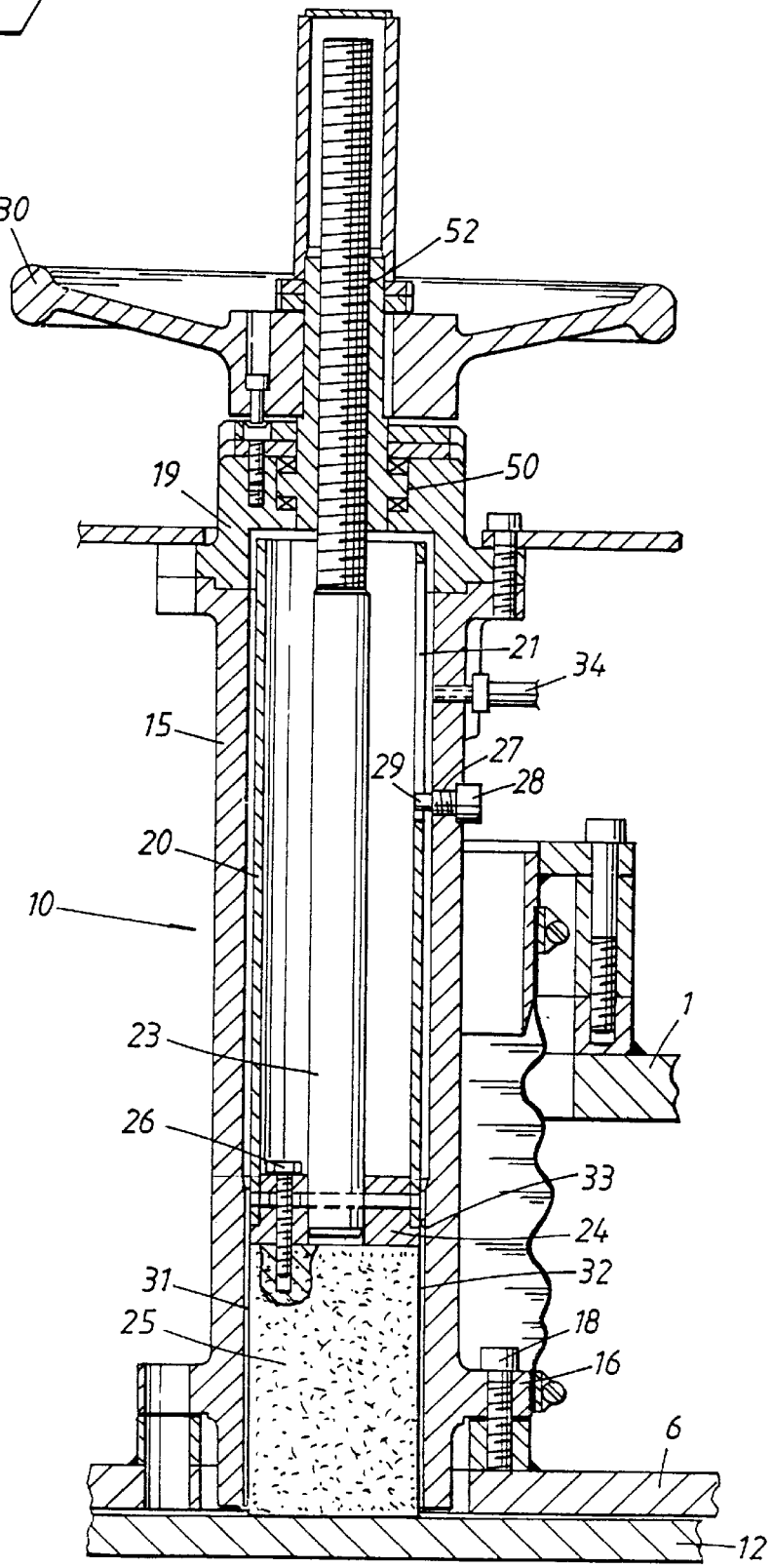
FIG. 2*a* is a longitudinal section through a device with a stop bar at a sector plate end taken along line II—II in FIG. 1.

FIG. 2*a* discloses a part of the housing 1 and the upper edge flange 12 of the rotor 2 and the upper movable sector plate 6. One of the support devices 10 is mounted by screws in a hole in the sector plate 6. The support device 10 comprises a socket 15 provided with a mounting flange 16, which with an intermediate sealing ring is attached by screws 18 to the sector plate 6.

At the top the socket 15 is provided with a lid 19, and inside the socket 15 an inner sleeve 20 with open top is positioned with an upper part that is provided with an axial slot 21. At the bottom of the socket 15 a cylindrical stop bar 25 is slidably journalled with a small clearance to the inside 33 of the socket 15. In the bottom end of the socket 15 a bottom plate 24 is situated attached to an adjusting rod 23. The stop bar 25 made of carbon or graphite is replaceably attached at the underside of the plate 24 by a set screw 26 screwed into the bottom plate 24.

The upper end of the socket 15 is provided with a screw 28 screwed into a radial tapped hole 27, which screw has a finger 29 inserted into the slot 21 thus preventing the inner sleeve 20 and the stop bar 25 from turning in the socket 15.

Adjustment of the clearance between the sector plate 6 and the edge flange 12 is made possible by the inner sleeve 20 with the stop bar 25 being axially displaceable in the socket 15 with the finger 29 in the slot 21 permitting displacement of the of the inner sleeve 20 with the stop bar 25 without turning. The displacement can be affected in many ways. An uncomplicated and efficient device consists of the rod 23 journalled in a hole 50 of the lid 19, which rod has a fine-threaded part extending through a fine-threaded opening 52 in a wheel 30 which is rotatably journalled on top of the lid 19.

The rod 23 and the stop bar 25 are displaced in relation to the sector plate 6 when the wheel 30 is turned. When the intended adjustment is achieved the rod 23 is locked by the threads of the wheel 30 and the rod 23 works as a self-locking gear.

Initially a clearance of for instance 4 mm is set between the sector plate 6 and the edge flange 12 by turning of the wheel 30.

The stop bar 25 will get worn during operation and the sector plate 6 will sink slowly down towards the edge flange 12 correspondingly. The remaining clearance after some time of operation is checked when necessary. When the heat exchanger is new the wear is fast, and the stop bar 25 has to be replaced soon. After that the wear will occur essentially slower because the first stop bar has deposited a layer of lubricating carbon or graphite on the edge flange 12.

The stop bars are situated in an ambient temperature of normally 350° C. and in a usually corrosive atmosphere in which fly ash usually whirls round. Practical tests have proved that it is impossible to prevent an impractically heavy wear of the stop bars due to the formation of irregularities on the edge flanges during their motion between the sector plates.

Figure 2B:
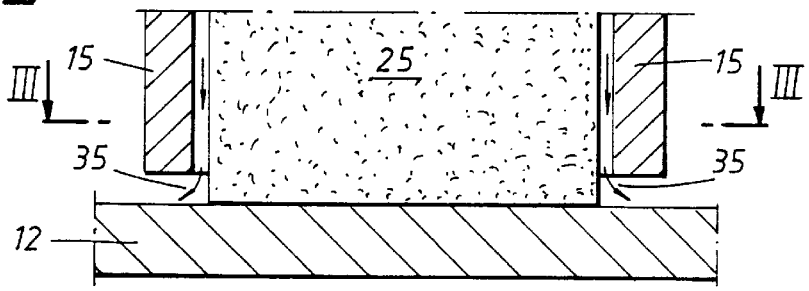
FIG. 2*b* is a longitudinal section through a lower portion of the stop bar and its socket.
Figure 3A:
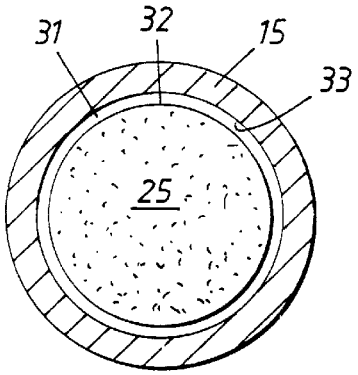
FIG. 3*a,* FIG. 3*b* and FIG. 3*c* are sectional views taken along line III—III in FIG. 2*b* showing three variants of stop bars with surrounding socket.

The clearance 31 between the periphery 32 of the stop bar 25 and the inside 33 of the socket 15 therefore has been given, according to the invention, a thickness of a few tenths of a mm, as shown in FIG. 3*a,* so that at the supply of a pressure medium (i.e., air, water or steam) through a hollow nipple 34 in the wall of the socket 15 an axial curtain 35 is formed by the pressure medium round the periphery of the stop bar, as shown in FIG. 2*b.* As a consequence thereof an efficient cleaning by blowing is obtained with respect to the edge flange 12 around the stop bar 25, and at the same time a cooling of the stop bar and the edge flange.

In principle it may be sufficient with one single through passage at the front edge of the stop bar 25 instead of a complete curtain, or as an alternative, a passage at the front edge and a passage at the rear edge, as previously mentioned.

A more or less continuous pressure medium curtain is, however, more efficient and easy to attain.

Figure 3B:
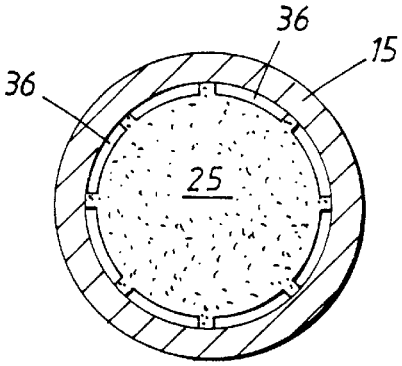
Figure 3C:
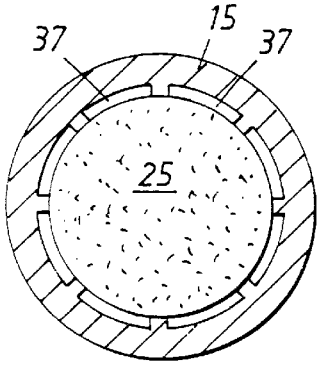

The stop bar 25 can, for example, be provided with axial recesses or grooves 36 in the peripheral surface, as shown in FIG. 3*b.* As an alternative the inside of the socket 15 can be provided with axial grooves 37, as shown in FIG. 3*c.*

Figure 4:
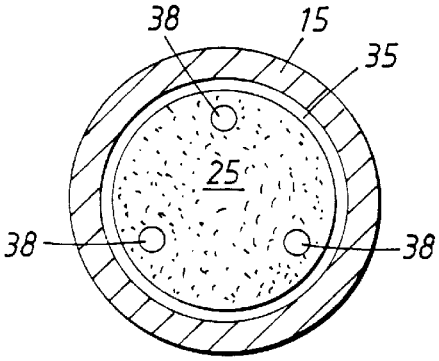
FIG. 4 is a sectional view similar to FIG. 3*a* and provided with three axial, through channels.

Optimum results may be obtained with an embodiment according to FIG. 4 with a continuous curtain 35 arranged to form a so called skirt surrounding a more or less marked pressure cushion caused by axially directed pressure medium jets in through passages (or passageways) 38 arranged in the stop bars within their peripheral surfaces. Cleaning by blowing, cooling, and pressure cushion can be obtained at the same time in this simple way.

I claim:

1. A regenerative heat exchanger comprising:

a first part which is essentially cylindrical and which contains a regenerator mass;

a second part which comprises axially directed inlet ducts and outlet ducts for heat emitting and heat absorbing media, said inlet and outlet ducts being separated from each other by sector shaped plates positioned for sealing purposes close to end surfaces of the first part, said sector shaped plates being pivotally connected to axially fixed center plates positioned at ends of the first part and attached to the second part;

at least one cylindrical stop bar provided at a radial outer end of each of the sector shaped plates for setting a clearance between the radial outer ends of the sector shaped plates and respective edge flanges provided at each end of the first part, said stop bars being mounted perpendicular to the sector shaped plates and being journalled in an axially displaceable manner in respective cylindrical sockets provided at the radial outer ends of the sector shaped plates, and said stop bars being adjustable by a screw mechanism connected to the respective ends of the sector shaped plates; and at least one axial through passage, formed between a peripheral surface of each of the stop bars and an inside surface of the respective cylindrical sockets, through which a first pressurized fluid may be applied, wherein one of the first part and the second part is rotatable relative to the other one of the first part and the second part around a common center axis.

2. The regenerative heat exchanger according to claim 1, wherein said axial through passages extend essentially around an entire periphery of each of the stop bars.

3. The regenerative heat exchanger according to claim 1, wherein said axial through passages comprise shallow, axial grooves formed in the peripheral surface of each of the stop bars.

4. The regenerative heat exchanger according to claim 1, wherein said axial through passages comprise shallow, axial grooves formed in the inside surface of the respective cylindrical sockets.

5. The regenerative heat exchanger according to claim 1, further comprising at least one essentially axial passageway, arranged within the peripheral surface of each of the stop bars, through which a second pressurized fluid may be applied.

6. A method of using the regenerative heat exchanger according to claim 5, wherein said first fluid is applied at a higher pressure than said second fluid.

7. The regenerative heat exchanger according to claim 1, further comprising a guide cooperating with the respective cylindrical sockets to prevent the stop rods journalled therein from turning.

8. A method of using the regenerative heat exchanger according to claim 1, wherein the first fluid is applied with a sufficient pressure for reducing at least a part of a pressure of the stop bars against the respective edge flanges.

9. The regenerative heat exchanger according to claim 2, further comprising at least one essentially axial passageway, arranged within the peripheral surface of each of the stop bars, through which a second fluid may be applied.

10. The regenerative heat exchanger according to claim 3, further comprising at least one essentially axial passageway, arranged within the peripheral surface of each of the stop bars, through which a second fluid may be applied.

11. The regenerative heat exchanger according to claim 4, further comprising at least one essentially axial passageway, arranged within the peripheral surface of each of the stop bars, through which a second fluid may be applied.

12. A method of using the regenerative heat exchanger according to claim 5, wherein said first fluid is applied at a higher pressure than said second fluid.

13. The regenerative heat exchanger according to claim 2, further comprising a guide cooperating with the respective cylindrical sockets to prevent the stop rods journalled therein from turning.

14. The regenerative heat exchanger according to claim 3, further comprising a guide cooperating with the respective cylindrical sockets to prevent the stop rods journalled therein from turning.

15. The regenerative heat exchanger according to claim 4, further comprising a guide cooperating with the respective cylindrical sockets to prevent the stop rods journalled therein from turning.

16. The regenerative heat exchanger according to claim 5, further comprising a guide cooperating with the respective cylindrical sockets to prevent the stop rods journalled therein from turning.

17. The regenerative heat exchanger according to claim 6, further comprising a guide cooperating with the respective cylindrical sockets to prevent the stop rods journalled therein from turning.

18. A method of using the regenerative heat exchanger according to claim 2, wherein the first fluid is applied with a sufficient pressure for reducing at least a part of a pressure of the stop bars against the respective edge flanges.

19. A method of using the regenerative heat exchanger according to claim 3, wherein the first fluid is applied with a sufficient pressure for reducing at least a part of a pressure of the stop bars against the respective edge flanges.

20. A method of using the regenerative heat exchanger according to claim 4, wherein the first fluid is applied with a sufficient pressure for reducing at least a part of a pressure of the stop bars against the respective edge flanges.

21. A method of using the regenerative heat exchanger according to claim 5, wherein the first fluid is applied with a sufficient pressure for reducing at least a part of a pressure of the stop bars against the respective edge flanges.

22. A method of using the regenerative heat exchanger according to claim 6, wherein the first fluid is applied with a sufficient pressure for reducing at least a part of a pressure of the stop bars against the respective edge flanges.

23. A method of using the regenerative heat exchanger according to claim 7, wherein the first fluid is applied with a sufficient pressure for reducing at least a part of a pressure of the stop bars against the respective edge flanges.

* * * * *